United States Patent [19]

Igarashi et al.

[11] Patent Number: 4,717,593

[45] Date of Patent: Jan. 5, 1988

[54] HEAT-SENSITIVE RECORDING SHEET

[75] Inventors: Akira Igarashi; Sukenori Nakamura, both of Shizuoka, Japan

[73] Assignee: Fuji Photo Film Co., Ltd., Kanagawa, Japan

[21] Appl. No.: 435,862

[22] Filed: Oct. 21, 1982

[30] Foreign Application Priority Data

Oct. 21, 1981 [JP] Japan ..... 56-168140

[51] Int. Cl.[4] ..... B41M 3/12

[52] U.S. Cl. ..... 427/150; 427/151; 427/395

[58] Field of Search ..... 427/150, 151, 395

[56] References Cited

U.S. PATENT DOCUMENTS

| | | | |
|---|---|---|---|
| 4,286,017 | 8/1981 | Nakamura et al. | 427/150 |
| 4,333,990 | 6/1982 | Yamato et al. | 427/150 |
| 4,339,492 | 7/1982 | Mino et al. | 427/150 |

*Primary Examiner*—Janyce A. Bell

*Attorney, Agent, or Firm*—Sughrue, Mion, Zinn, Macpeak & Seas

[57] ABSTRACT

A heat-sensitive recording sheet obtained by applying aqueous dispersions of an electron donating colorless dye and an electron accepting compound to a base is disclosed. This heat-sensitive recording sheet is characterized in that at least one of the aqueous dispersion of the electron donating colorless dye and the aqueous dispersion of the electron accepting compound is dispersion prepared by dispersing by means of a horizontal sand mill.

6 Claims, 3 Drawing Figures

HEAT-SENSITIVE RECORDING SHEET

FIELD OF THE INVENTION

The present invention relates to a heat-sensitive recording sheet. More particularly, the present invention relates to a heat-sensitive recording sheet which includes an aqueous dispersion of an electron donating colorless dye prepared by dispersing by means of a horizontal sand mill and/or an aqueous dispersion of an electron accepting compound prepared by dispersing by means of a horizontal sand mill.

BACKGROUND OF THE INVENTION

A heat-sensitive recording sheet forms images by physical or chemical changes of materials by heat energy. A number of processes for forming images with such sheets have been studies.

An example of a heat-sensitive recording sheet utilizing physical change of materials by heat is wax type heat-sensitive recording paper which is utilized for cardiograms as described in U.S. Pat. No. 3,131,080. With respect to heat-sensitive recording sheets utilizing chemical change, various kinds of development mechanisms have been proposed as described in U.S. Pat. Nos. 2,663,654, 2,663,655 and 2,967,785. A typical example is a two-component development heat-sensitive recording sheet.

The two-component development heat-sensitive recording sheet is prepared by finely dispersing two kinds of heat-reactive compounds, adding a binder and applying the dispersion to a base so that two kinds of heat-reactive compounds are separated from each other by the binder. Recording is carried out by a color forming reaction which takes place between the reactive compounds after heat is applied and they contact each other. These two kinds of heat-reactive compounds are generally called an electron donating compound and an electron accepting compound, and there are a considerable number of combinations of them. Roughly classified, ombinations which form metal compound images and combinations which form dye images are known.

These two-component development heat-sensitive recording sheets have a number of advantages, for example, (1) development is not necessary because of primary color formation, (2) the quality of the paper used is similar to conventional paper, and (3) handling of them is easy. Particularly, when using a colorless dye as the electron donating compound, there are some additional advantages such as (4) the color density is high and (5) heat-sensitive recording sheets yielding various color hues can be easily produced and their utilization value is great. Accordingly, they have been broadly used as heat-sensitive recording materials.

The heat-sensitive recording sheets having the above described excellent advantages have recently been utilized as image receiving paper for recording facsimile communication.

When the heat-sensitive recording sheets are used as recording paper for a facsimile, the construction of instruments is simplified, because the development step is not necessary. Furthermore, no material other than the recording paper need be consumed and there are many advantages with respect to maintenance. However, such materials are not desirable because during thermal recording the recording speed is low. This is believed to be caused by the fact that the thermal recording head and the heat-sensitive recording material used have inferior heat-response. Although thermal recording heads having a good heat-response have been developed in recent years, a heat-sensitive recording sheet which sufficiently satisfies the requirement has not yet been provided. Thus, it has been desired to develop such heat-sensitive recording sheets.

The present inventors have thought that an important matter for attaining the above described object is to uniformly and finely disperse the electron donating colorless dye (referred to as color former, hereinafter) and the electron accepting compound (referred to as color developer, hereinafter) in an aqueous solution. It has been found that a horizontal sand mill gives excellent results with respect to dispersing.

In a conventional process for producing heat-sensitive recording sheets, a color former and a color developer are dispersed, respectively, in an aqueous solution of a water-soluble binder by means of a ball mill and they are mixed. Thereafter the resulting dispersions are applied to a base after adding, if necessary, organic or inorganic pigments, waxes or releasing agents. Production of the dispersion of fine uniform particles in the dispersing step in this process is a primary factor for determining the heat-response. Previously, ball mills, attriters, sand mills, and three-roller mills have been used for dispersing. However, the ball mills and attriters have an inferior operation efficiency, because they are used as a batch system, and the particle size of the resulting dispersion in case of using conventional color formers and color developers is 3 μm to 5 μm on the average, which is not always sufficiently small. Moreover, some attriters and sand mills cannot yield uniform fine particles, though continuous operation can be carried out, and the average particle size is also limited to 3 μm to 5 μm or so at most. Further, the distribution of particle size is rather broad.

As a result of studying these matters, the present inventors have made the following discoveries. When using ball mills and attriters, etc., the quantity of motion of the balls or media is small. Accordingly, production of fine particles is naturally limited because only a small shearing force is applied to the dispersoid. Further, when using the prior continous attriters and sand mills, a vessel is provided in the perpendicular direction so that the dispersion medium flows (generally) towards the upper part from the lower part. Accordingly, the distribution of concentration of the dispersoid is formed in the vertical direction of the vessel based on specific gravity differences between the dispersion with broad distribution of particle size. Accordingly, it is difficult to easily produce fine particles. This tendency becomes great when the amount of flow of the dispersion medium is reduced in order to obtain fine particles. Futher, when heat-fusible substances such as a melting point dropping agent are dispersed simultaneously with the color former and the color developer in order to improve the heat-response of the heat-sensitive recording sheet, separation of the raw materials is caused during dispersing because each has a different specific gravity. Consequently, there is the problem that the composition of the vomited finely dispersed solution or the particle size of dispersoids thereof is different from that of the crude dispersion to be introduced. In general, since the specific gravity of a melting point dropping agent is small, the composition of the vomited solution contains a melting point in a large proportion at the initial dispersion. Further, the melting point dropping agent is easily vomited. Accordingly, the dispersing time in dispersing vessel is short and the extent of dispersing is relatively small. Contrary thereto, the time for dispersing the color former and color developer is longer than the case of the melting point dropping agent. Accordingly, the crushing thereof is more proceeded and the particle sizes of the color former and color developer become small as compared with that of the melting point dropping agent.

SUMMARY OF THE INVENTION

When dispersion of heat-sensitive raw materials is carried out by means of the so-called horizontal sand mill equipped with a vessel for dispersing in the horizontal direction, remarkably excellent results can be obtained. Thus the present invention has been attained.

The present invention relates to a heat-sensitive recording sheet obtained by applying aqueous dispersions of an electron donating colorless dye and an electron accepting compound to a base. The invention is characterized in that at least one of the aqueous dispersion of the electron donating colorless dye and the aqueous dispersion of the electron accepting compound is prepared by dispersing by means of a horizontal sand mill.

DETAILED DESCRIPTION OF THE INVENTION

Figure 1:
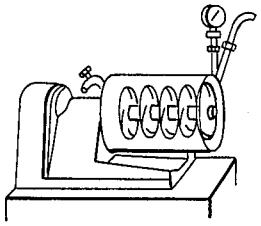
FIG. 1 is a perspective view showing the external appearance of the horizontal sand mill of the present invention.
Figure 2:
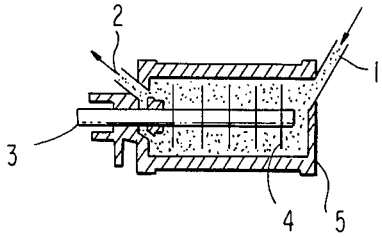
FIG. 2 is a cross-sectional view of a vessel part of the sand mill shown in FIG. 1 wherein 1 is an inlet for the dispersion, 2 is an outlet for the dispersion, 3 is an agitator shaft, 4 is an agitator blade, and 5 is a vessel.

FIG. 1 shows the horizontal sand mill equipped with a vessel 5 for dispersing in the horizontal direction. The vessel 5 is packed with media having a size of 0.2 mm to 5 mm, such as glass beads or alumina. An agitator comprised of a shaft 3 and a blade 4 is placed horizontally in the container 5. Dispersing is carried out by revolving the agitator at a high rate. When the heat-sensitive raw materisls are dispersed using such a dispersing apparatus, the following advantages are obtained:

(1) Production of fine particles of color former and color developer can be easily obtained, because dispersing is carried out with a high shearing force.

(2) The flow of the dispersion medium is horizontal. Accordingly, residence time in the vessel is kept nearly constant regardless of the specific gravity of dispersoids and a stabilized dispersion having a sharp distribution can be obtained. The method is particularly effective when carrying out dispersing simultaneously by mixing the color former or the color developer with additives such as heat-fusible substances. Almost no separation of the raw materials or variation of the composition is created.

Examples of typical color formers used in the present invention include: (1) triarylmethane compounds, (2) diphenylmethane compounds, (3) xanthene compounds, (4) thiazine compounds, and (5) spiropyran compounds, examples of which have been described in U.S. Pat. No. 4,283,458. Triarylmethane and xanthene color formers are particularly preferred because they do not cause much fog and create high color density. Specific examples of these color formers include Crystal Violet lactone, 2-anilino-3-methyl-6-diethylaminofluoran, 2-anilino-3-methyl-6-tolylethylaminofluoran, 2-anilino-3-methyl-6-cyclohexylmethylaminofluoran, 2-$\beta$-ethoxyethylamino-3-chloro-6-diethylaminofluoran and 2-o-chloroanilino-6-diethylaminofluoran. The preferred particle size of the color formers used in the present invention is 1 mm or less.

The color developers, which are preferred, are compounds which are solid at room temperature and, particularly, those having a melting point of 80° C. or more. The compounds are preferably phenols and aromatic carboxylic acid derivatives.

Examples of particularly preferred compounds include phenols such as p-octylphenol, p-tert-butylphenol, p-phenylphenol, 1,1-bis(p-hydroxyphenyl)-2-ethylbutane, 2,2-bis(p-hydroxyphenyl)propane, 2,2-bis(p-hydroxyphenyl)pentane, 2,2-bis(p-hydroxyphenyl)hexane and 2,2-bis(4-hydroxy-3,5-dichlorophenyl)propane.

Of the above compounds, bisphenols are particularly preferred because the color density is high and the preservation stability is comparatively excellent. The preferred particle size of the color developers used in the present invention is 1 mm or less.

Examples of preferred aromatic carboxylic acid derivatives include p-hydroxybenzoic acid, ethyl p-hydroxybenzoate, butyl p-hydroxybenzoate, benzyl p-hydroxybenzoate, 3,5-di-tert-butylsalicylic acid, 3,5-di-$\alpha$-methylbenzylsalicylic acid and polyvalent metal salts of the above described carboxylic acids.

In order to improve the heat-response, heat-fusible substances are added together with the color formers and the color developers. It is more effective to disperse these heat-fusible substances simultaneously while dispersing the color former and/or the color developer.

Examples of these substances include higher aliphatic acid amides (stearic acid amide, palmitic acid amide, erucic acid amide and oleic acid amide), ethylene-bis-stearoamide, acetanilide, acetoacetic acid amide and derivatives of them. Straight chain higher aliphatic acid amide having 12 to 24 carbon atoms is particularly preferred.

Dispersing of the color former and the color developer is generally carried out with an aqueous solution of water-soluble high polymers as a dispersion medium. Examples of water-soluble high polymers include water-soluble synthetic high polymers such as polyacryl-amide, polyvinyl pyrrolidone, polyvinyl alcohol, styrene-maleic acid anhydride copolymer, ethylene-maleic acid anhydride copolymer or isobutylene-maleic acid anhydride copolymer, etc., and water-soluble natural high polymers such as hydroxyethyl cellulose, starch derivatives, gelatin or casein, etc., and modified products thereof. The water-soluble high polymers having a molecular weight of about 20,000 to 200,000 are particularly preferred. These water-soluble high polymers are used as an aqueous solution having a concentration of 1 to 20% by weight, preferably 3 to 10% by weight. If the concentration is less than 1%, stability of the dispersed particles is extremely inferior and cohesion may be caused during the heating step. If the concentration is higher than 20%, the viscosity of the dispersion increases remarkably which requires the use of a large amount of energy to perform the dispersion.

The color former and color developer in the dispersion preferably have an average particle size of about 0.5 to 3 μm, respectively. If the average particle size is beyond the above described range, the heat-response is generally insufficient: If it is lower than the above described range, fogging is caused or a large amount of energy is necessary to carry out dispersion.

The dispersion of the color former and that of the color developer are blended such that the ratio of the color former to the color developer is in the range of 1:1 to 1:10, preferably, 1:2 to 1:4. If necessary, inorganic or organic oil-absorbing pigments, waxes and releasing agents may be added.

Preferred examples of inorganic or organic oil-absorbing pigments are those having an oil-absorption of 50 ml/100 g or more by JIS-K5101. Specific examples of these pigments include kaolin, calcined kaolin, talc, agalmatolite, diatom earth, calcium carbonate, aluminium hydroxide, magnesium hydroxide, magnesium carbonate, titanium oxide, barium carbonate, urea-formalin filler, and cellulose filler.

Specific examples of the waxes used include paraffin wax, polyethylene wax and carnauba wax and highe aliphatic acid amides may also be added as a state of emulsion.

Polyvalent metal salts of higher aliphatic acids are generally used as releasing agents and zinc salts are particularly preferred.

The resulting heat-sensitive coating solution is applied to a base such as paper or plastics, and dried at about 50° to 90° C. The upper limit of the drying temperature is less than the initial temperature for the coloration of the coating solution. Further, the drying treatment is carried out so that the moisture content of the heat-sensitive recording sheet is within the range of from about 5% by weight to about 9% by weight. The base paper is coated such that the color former is present in an amount of 0.1 g/m$^2$ to 0.7 g/m$^2$, preferably 0.2 g/m$^2$ to 0.5 g/m$^2$.

In the following, specific examples of the present invention is described. However, this invention is not limited to these examples.

EXAMPLE 1

1 kg of the color former: 2-β-ethoxyethylamino-3-chloro-6-diethylaminofluoran was added to 5 kg of a 5% aqueous solution of polyvinyl alcohol (degree of polymerization: 500, saponification value: 99%). After being dispersed roughly by a homogenizer, the dispersion was processed by the horizontal sand mill (Dynomill type KD-PILOT produced by Willy A. Bachofen Co. in Switzerland) at a processing rate of 0.3 l/minute. The particle size of the dispersion was 1.2 μm and the standard deviation was 1.1 μm. The measurement of the particle size was carried out by a particle size distribution tester TA-type II made by U.S. Colter Counter Co.

EXAMPLE 2

1 kg of the color former: 2-anilino-3-methyl-6-cyclohexylmethylaminofluoran and 1 kg of 2-(o-chloroanilino)-6-diethylaminofluoran were added to 10 kg of a 5% aqueous solution of polyvinyl alcohol. After being dispersed roughly by a homogenizer, the dispersion was processed by the same manner as in Example 1. The average particle size of the dispersion was 2.2 μm and the standard deviation was 1.9 μm. When the composition of the processed dispersion after being dried was examined by high speed liquid chromatography, no change in the composition was observed between the dispersion just after initiation of the processing and the dispersion just before conclusion of the processing.

EXAMPLE 3

1 kg of the color developer: 2,2-bis(p-hydroxyphenyl)propane and 1 kg of the melting point dropping agent: stearic acid amide were added to 10 kg of a 5% aqueous solution of polyvinyl alcohol, and the mixture was roughly dispersed by a homogenizer. The dispersion was processed in the same manner as in Example 1. The average particle size of the dispersion was 2.8 μm and the standard deviation was 1.9 μm. No change in the composition was observed between the dispersion just after initiation of the processing and the dispersion just before conclusion.

EXAMPLE 4

The same procedure was carried out as in Example 1, except that 2-anilino-3-methyl-6-diethylaminofluoran was used as the color former. The average particle size was 2.1 μm.

COMPARATIVE EXAMPLE 1

Dispersing of same components as in Example 1 was carried out for 12 hours, 24 hours and 48 hours with using a 20 l ball mill packed with 5 l of alumina balls (20 mm ϕ) instead of the horizontal sand mill in Example 1. The average particle size in each case was 5.1 μm, 3.6 μm and 3.4 μm, and the standard deviation thereof was 6.2 μm, 5.8 μm and 5.8 μm, respectively.

COMPARATIVE EXAMPLE 2

Dispersing was carried out under the same conditions (same components and processing rate of 0.3 l/minute) as in Example 2, except that a vertical sand mill: type ⅛G (produced by Igarashi Kikai Co.) was used instead of the horizontal sand mill. The average particle size of the resulting dispersion was 3.8 μm, and the standard deviation was 4.1 μm. Just after initiation of the processing, the ratio of 2-anilino-3-methyl-6-cyclohexylmethylaminofluoran was 60% which was somewhat high (i.e., the composition ratio of 2-anilino-3-methyl-6-cyclohexylmethylaminofluoran to 2-(o-chloroanilino)-6-diethylaminofluoran is 0.6:0.4). Just before conclusion, the composition became nearly the same as the initial ratio of these components charged (i.e., the composition ratio of 1:1).

COMPARATIVE EXAMPLE 3

In Example 3, processing was carried out with the same vertical sand mill as in Comparative Example 2, but stearic acid amide in the processed dispersion was in a state of being hardly dispersed and dispersing thereof was impossible.

Figure 3:
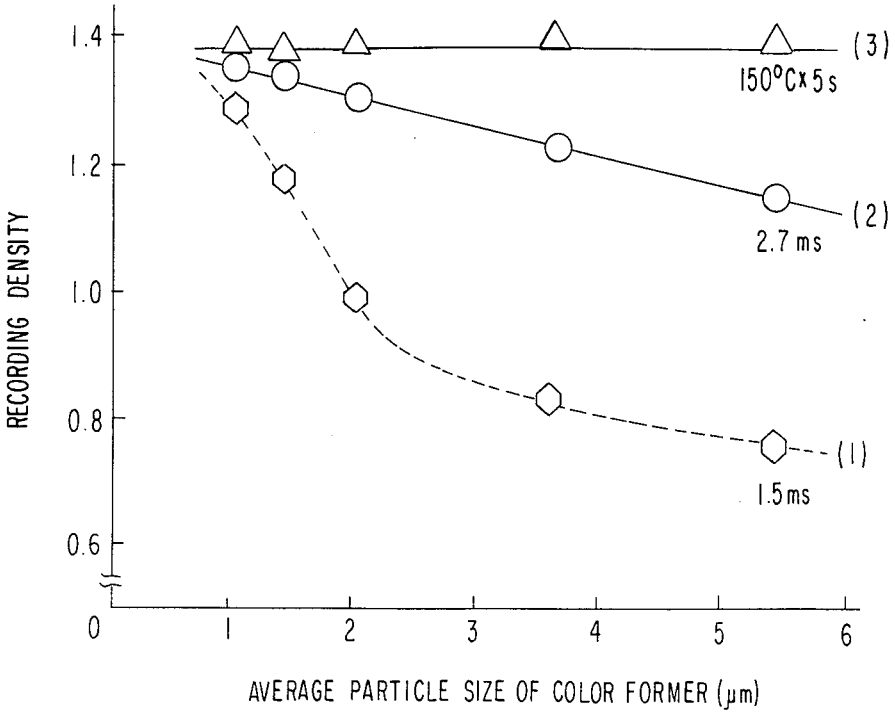
FIG. 3 is a graph showing the relationship between the average particle size of the color former and the recording density in the heat-sensitive recording paper comprising the same color developer and the same color former.

For reference, the influences of the average particle size of the color former on a recording density are shown in FIG. 3. In this comparison, the recording densities were measured, wherein only the average particle size of the color former varies in the heat-sensitive paper comprising the same color developer and the same color former. The color former was applied on the base paper in the coating amount of 0.4 g/m$^2$. Recording was carried out at a width of heat-application pulses of 1.5 ms (Symbol ⬡) or 2.7 ms (Symbol ○) by means of PANAFAX-7000 produced by Matsushita Densokiki Co. An example of carrying out heating at 150° C. for 2 seconds (Symbol Δ) is also shown. It is understood from the Figure that the recording density in high speed recording (short pulse recording) depends greatly upon the particle size of raw materials (color former in this case).

While the invention has been described in detail and with reference to specific embodiments thereof, it will be apparent to one skilled in the art that various changes and modifications can be made therein without departing from the spirit and scope thereof.

What is claimed is:

1. A process for preparing a heat-sensitive recording sheet, comprising the steps of:

providing a support base sheet;

preparing a first dispersion of an aqueous solution of water-soluble high polymers containing an electron donating colorless dye;

preparing a second dispersion of an aqueous solution of water-soluble high polymers containing an electron accepting compound, the second dispersion being prepared by dispersing the electron accepting compound in the aqueous solution by means of a horizontal sand mill;

applying the mixture of the first and second dispersion to the support base sheet; and drying in order to form the heat-sensitive recording sheet.

2. A process for preparing a heat-sensitive recording sheet, comprising the steps of:

providing a support base sheet;

preparing a first dispersion of an aqueous solution of water-soluble high polymers containing an electron donating colorless dye, the first dispersion being prepared by dispersing the electron donating colorless dye in the aqueous solution by means of a horizontal sand mill;

preparing a second dispersion of an aqueous solution of water-soluble high polymers containing an electron accepting compound;

applying the mixture of the first and second dispersions to the support base sheet; and drying in order to form the heat-sensitive recording sheet.

3. A process for preparing a heat-sensitive recording sheet as claimed in claim 2, wherein the second dispersion is prepared by dispersing the electron accepting compound in the aqueous solution by means of a horizontal sand mill.

4. A process for preparing a heat-sensitive recording sheet as claimed in any of claims 1, 2 or 3, wherein the aqueous solution of water-soluble high polymers is an aqueous solution containing a concentration of the polymers in an amount of 1 to 20% by weight.

5. A process for preparing a heat-sensitive recording sheet as claimed in claim 4, wherein the concentration of the polymer within the aqueous solution is 3 to 10% by weight.

6. A process for preparing a heat-sensitive recording sheet as claimed in any of claims 1, 2 and 3, wherein the electron donating colorless dye or the electron accepting compound has an average particle size of about 0.5 to 3 μm.

* * * * *